US007978860B2

(12) United States Patent
Miura et al.

(10) Patent No.: US 7,978,860 B2
(45) Date of Patent: Jul. 12, 2011

(54) PLAYBACK APPARATUS AND PLAYBACK METHOD

(75) Inventors: Masayoshi Miura, Chiba (JP); Susumu Yabe, Tokyo (JP)

(73) Assignee: Sony Corporation, Tokyo (JP)

( * ) Notice: Subject to any disclaimer, the term of this patent is extended or adjusted under 35 U.S.C. 154(b) by 1480 days.

(21) Appl. No.: 11/392,581

(22) Filed: Mar. 30, 2006

(65) Prior Publication Data

US 2006/0269070 A1 Nov. 30, 2006

(30) Foreign Application Priority Data

Apr. 18, 2005 (JP) ..... P2005-119155

(51) Int. Cl.
*H04R 5/00* (2006.01)
*H04R 5/02* (2006.01)

(52) U.S. Cl. ..... 381/18; 381/1; 381/17; 381/19; 381/300

(58) Field of Classification Search ..... 381/300, 381/94.1, 92, 1, 17–19, 56–59
See application file for complete search history.

(56) References Cited

U.S. PATENT DOCUMENTS 5,796,845 A * 8/1998 Serikawa et al. ..... 381/18
5,949,894 A * 9/1999 Nelson et al. ..... 381/300
7,515,719 B2 * 4/2009 Hooley et al. ..... 381/18
2006/0013412 A1 * 1/2006 Goldin ..... 381/94.1
2006/0115091 A1 * 6/2006 Kim et al. ..... 381/18

FOREIGN PATENT DOCUMENTS

JP 63-26198 2/1988

OTHER PUBLICATIONS

Katsumi Nakabayashi, "A Method of Analyzing the Quadraphonic Sound Field and Its Application", Journal of the Acoustical Society of Japan, vol. 33, No. 3, pp. 116-127, Mar. 1977.
Yoshio Yamazaki, "Kirschhoff-sekibun-hoteishiki-ni Motozuku Sanjigen-barcharuriarithi-ni Kansuru Kenkyu (Study on Virtual Reality based on Kirchhoff's Integral Equation)" Waseda University, Advance Research Institute for Science and Engineering, Acoustic Laboratory.

* cited by examiner

*Primary Examiner* — Devona E Faulk
(74) *Attorney, Agent, or Firm* — Finnegan, Henderson, Farabow, Garrett & Dunner, L.L.P.

(57) ABSTRACT

A playback apparatus includes a forming section which, on the basis of an audio signal to be played back, forms audio signals on a plurality of channels for emitting sounds from a pair of sound sources, and a signal processing section which, on each of the audio signals formed by the forming section, performs signal processing for forming a targeted sound field. The signal processing section inclines a sound pressure distribution so that, for each sound source, sound pressure levels of sounds emitted from the sound source to a listening position increase in inverse proportion to angles formed between emitting directions of the sounds emitted from the sound source to the listening position and a straight line connecting the pair of sound sources.

7 Claims, 11 Drawing Sheets

FIG. 9

KIRCHIHOFF'S INTEGRAL FORMULA $$p(r_i)=\int_S \left(p(r_j)\frac{G_{ij}}{n}+j\omega\rho u_n(r_j)G_{ij}\right)ds \quad \cdots(1)$$

WHERE $$G_{ij}=\frac{\exp(-jk|r_i-r_j|)}{4\pi|r_i-r_j|} \quad \cdots(2)$$

$$p(r_i)=\sum_{j=1}^{N} p(r_i)\int_{S_j}\frac{G_{ij}}{n}ds+j\omega\rho\sum_{j=1}^{N} u_n(r_j)\int_{S_j}G_{ij}\,ds \quad \cdots(3)$$

EVALUATION FUNCTION $$J=\sum_{j=1}^{2N}\left(P_j-\sum_{i=1}^{M}H_iC_{ij}\right)^2 \quad \cdots(4)$$

$P_j$ : TRANSFER FUNCTION BETWEEN SOUND SOURCE IN ORIGINAL SOUND FIELD AND SOUND RECEIVING POINT j $$\frac{J}{H_i}=0 \qquad [i=1,\ 2,\ \cdots,\ M] \quad \cdots(5)$$

PLAYBACK APPARATUS AND PLAYBACK METHOD

CROSS REFERENCES TO RELATED APPLICATIONS

The present invention contains subject matter related to Japanese Patent Application JP 2005-119155 filed in the Japanese Patent Office on Apr. 18, 2005, the entire contents of which are incorporated herein by reference.

BACKGROUND OF THE INVENTION

1. Field of the Invention

The present invention relates to apparatuses and methods in which audio signals are played back and in which audio signals and video signals are played back synchronized with each other, and, in particular, to an apparatus and method that plays back a so-called "AV (audio/visual) signal".

2. Description of the Related Art

An intensity stereo system having two channels on left and right sides has been used as a system for playing back audio signals. For example, the intensity stereo system, having two audio channels on left and right sides, shown in FIG. 15, is discussed. Of the two audio channels, that is, left and right audio channels, the left channel is hereinafter abbreviated as the "L-ch", and the right channel is hereinafter abbreviated as the "R-ch". A speaker for the L-ch is hereinafter abbreviated as an "L-ch speaker", and a speaker for the R-ch is hereinafter abbreviated as an "R-ch speaker".

Normally, in intensity stereo recording, sound source signals based on a sound source such as a voice of a singer or movie sound are recorded as audio signals on the L-ch and the R-ch at equal levels and with the same timing so that reproduced sound can be heard from a central position. When reproduced sound is listened to by playing back the audio signals (sound source signals) in a normal manner by using the stereo reproduction system, shown in FIG. 15, having an L-ch and an R-ch, by listening to sounds emitted from the L-ch and R-ch speakers at user positions (listening positions) A and B in front of a central position SPC between the L-ch speaker and the R-ch speaker, the sounds can be heard as if they were being emitted from the central position SPC.

However, when, in FIG. 15, the emitted sounds are listened to at listening positions B and E which are close to the L-ch speaker, the emitted sounds can be heard as if they were being emitted from the L-ch speaker which is close to the user positions B and E. At listening positions C and F which are the listening positions disposed furthest away from the listening positions A and D, the sound emitted from the L-ch speaker can only be heard, the L-ch speaker being closer to the listening positions C and F. Accordingly, despite the fact that sound is being emitted from the R-ch speaker, it is difficult to hear the sound from the R-ch speaker.

This is because of the precedence effect in which, when sound sources emit identical or nearly identical complex signals, a listener perceives a sound image in the direction of a sound that first reaches the listener. Therefore, when a plurality of persons, for example, three persons view a music program or movie, a person in the middle can enjoy sound that is designed to be heard from the central position SPC, which is a localized position of the original sound image. However, each of the two persons on either side of the person in the middle hears sound that is closer to the nearer speaker, so that the sounds emitted from the L-ch and R-ch speakers are heard in an unnatural manner. In particular, when L-ch and R-ch speakers are installed a distance apart in a large room, and when a large screen television set having speakers on two sides of the screen is utilized, such unnaturalness is a problem.

To solve this problem, Japanese Unexamined Patent Application Publication No. 63-26198 discloses a technology which uses the precedence effect and the backward masking method (in which a first-arriving low-loudness sound is masked by a later-arriving high-loudness sound), and in which, as shown in, for example, FIG. 16, by dividing a listening area into three areas, a central area AC, a left area AL, and a right area AR, and using a plurality of directional speakers, a phase inversion circuit, and a delay circuit, a signal arrival time in each listening area and the level of the arriving signal are controlled so that good sound image localization can be obtained in any of the three listening areas.

FIG. 16 shows a case in which each of the L-ch and the R-ch has three speakers having different directionalities, that is, a front direction, a direction inward to the listening area, and a direction outward from the listening area.

SUMMARY OF THE INVENTION

The technology disclosed in Japanese Unexamined Patent Application Publication No. 63-26198 is highly effective since good sound image localization can be obtained in any of the three areas. However, this technology has problems in that, since generated sound fields are controlled by performing phase conversion and delaying, it is difficult to obtain desired effects in the vicinity of borders among the three areas, and in that no effect can be expected, in principle, outside (the listening positions C and F in FIG. 16) the positions of the L-ch and R-ch speakers. In addition, each speaker that is positioned to face the listening areas emits sound to outside of the listening areas that might be considered noise (unnecessary sound) by nonlisteners. In addition, the emitted sound is reflected back to the listening areas, so that the reflected sound may make it difficult to hear the emitted sound.

For example, when a listener can have a listening room for playing back music, and when a listener enjoys music alone, by disposing L-ch and R-ch speakers and at a listening point so as to be vertices of an equilateral triangle, a good reproduced sound field can be formed. However, in a location such as a living room, it is not necessarily possible to listen to sound emitted from the central position between the L-ch and R-ch speakers. In addition, when a plurality of persons, such as a family, hear sound, only one person can listen to the sound in front of the central position between L-ch and R-ch speakers, and each of the other persons hears the sound at a position close to the L-ch or R-ch speaker.

Accordingly, when sounds emitted from the L-ch and R-ch speakers are listened to at a position close to L-ch or R-ch speaker, it is difficult to perceive a sound image and stereo sound as intended by the content creator. In particular, in a case, such as watching television, in which the sound-corresponds to images displayed on the screen, mismatching can occur between an actor position in the images and corresponding sound image localization, so that a problem, such as the occurrence of unnaturalness due to the mismatching, may occur.

In view of the above-described circumstances, it is desirable to form a sound field so that a sound image and stereo sound can be perceived as intended by the content creator, even if a listener (user) is not positioned on a symmetric axis which is in the center between left and right speakers and which divides a listening area into two equal parts.

To solve the above problems, according to an embodiment of the present invention, there is provided a playback apparatus including forming means for forming, on the basis of an audio signal to be played back, audio signals on a plurality of channels for emitting sounds from a pair of sound sources, and signal processing means for performing, on each of the audio signals formed by the forming means, signal processing for forming a targeted sound field. The signal processing means inclines a sound pressure distribution so that, for each sound source of the pair of sound sources, sound pressure levels of sounds emitted from the sound source to a listening position increase in inverse proportion to angles formed between emitting directions of the sounds emitted from the sound source to the listening position and a straight line connecting the pair of sound sources.

According to the above embodiment of the present invention, the signal processing means performs signal processing on the audio signals on the channels which are formed by the forming means. The signal processing forms, for example, a pair of sound sources (sound emitting sources) such as an L-ch and an R-ch. In inverse proportion to angles formed between emitting directions (reaching directions to a listener) of sounds perceived as if they were being emitted from the pair of sound sources and a straight line connecting the pair of sound sources, sound pressure levels of the sounds can be increased so that a sound pressure distribution in a listening area has an inclination.

This equalizes reaching times (reaching timing) and sound pressure levels for both ears of the listener on a symmetrical axis having equal distances from the pair of sound sources. Thus, a sound image can be perceived as normal from the center of the pair of sound sources. Although, at a position close to either of the pair of sound sources, between sounds reaching both ears of the listener, a sound from a closer sound source has a small time difference between both ears (difference in reaching time of sound between both ears), a sound from a farther sound source has a larger level difference between both ears (different in sound pressure between both ears). Therefore, also at a position shifted to either of the pair of sound sources, on the basis of time-intensity trading between a level difference between both ears and a time difference between both ears, sound image perception can be made identical in the case of a listening position on a symmetrical axis in a listening area having equal distances from the pair of sound sources.

According to an embodiment of the present invention, even if, in a predetermined area having equal distances from a pair of sound sources, sounds from the sound sources are listened to, a sound image localization position and stereo sound can be made identical in the case of listening to emitted sounds from a pair of sound sources in a state with equal distances from the pair of sound sources. Therefore, wherever a listener is positioned, a reproduced sound field in which stereo sound and multichannel audio of movie can be enjoyed can be formed without causing the listener to feel discomfort due to movement of the sound image localization position depending on the listening position.

BRIEF DESCRIPTION OF THE DRAWINGS

FIG. 9 is an illustration including Kirchhoff's integral formula;

DESCRIPTION OF THE PREFERRED EMBODIMENTS

An apparatus and method according to an embodiment of the present invention are described below with reference to the accompanying drawings. In the embodiment described below, the case of applying the above apparatus and method to a playback apparatus for an optical disc such as a DVD (digital versatile disc) on which video data and audio data are recorded is exemplified.

Configuration and Operation of Playback Apparatus

Figure 1:
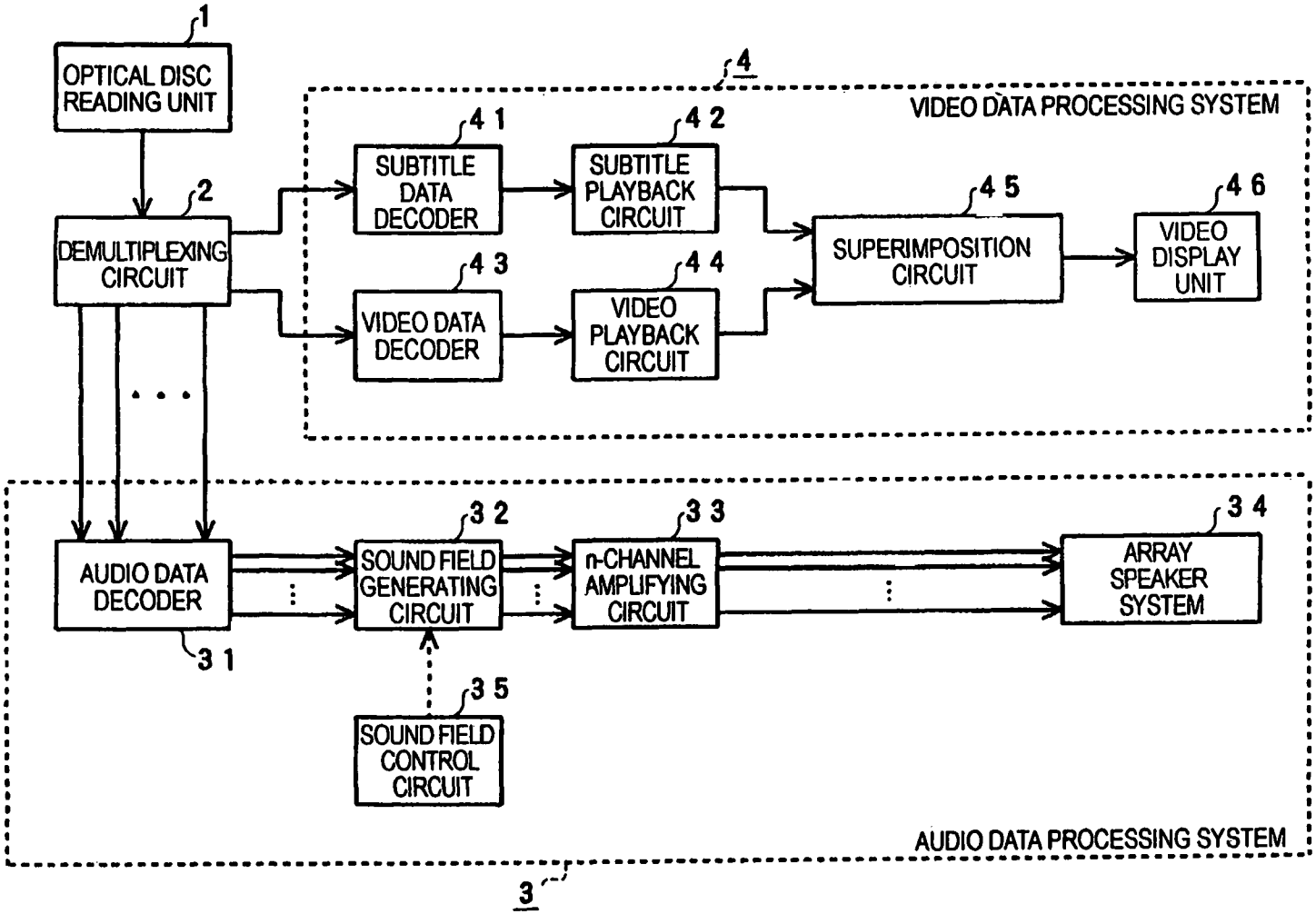
FIG. 1 is a block diagram showing an optical disc playback apparatus to which an embodiment of the present invention is applied.

FIG. 1 is a block diagram illustrating the playback apparatus according to the embodiment. As shown in FIG. 1, the playback apparatus according to the embodiment includes an optical disc reading unit 1, a demultiplexing circuit 2, an audio data processing system 3, and a video data processing system 4. The audio data processing system 3 includes an audio data decoder 31, a sound field generating circuit 32, an n-channel amplifying circuit 33, an array speaker system 34, and a sound field control circuit 35. The subtitle data decoder 41 includes a subtitle data decoder 41, a subtitle playback circuit 42, a video data decoder 43, a video playback circuit 44, a superimposition circuit 45, and a video display unit 46.

The optical disc reading unit 1 includes an optical disc loading section, an optical disc rotation driver including a spindle motor, an optical pickup section including an optical system such as a laser source, an objective lens, a biaxial actuator, a beam splitter, and a photo detector, a sled motor for moving the optical pickup section in a radial direction of the optical disc, and various types of servo circuits. These components are not shown in FIG. 1.

By emitting a laser beam to the optical disc when it is loaded and receiving a beam reflected by the optical disc, the optical disc reading unit 1 reads multiplex data which is recorded on the optical disk and in which video data, subtitle data, plural channel audio data, and various types of other data are multiplexed. The optical disc reading unit 1 performs necessary processing, such as error correction, on the read data, and supplies the processed data to the demultiplexing circuit 2.

In this embodiment, each of the video data, subtitle data, and plural channel audio data recorded on the optical disc is compressed in a predetermined encoding method.

The plural channel audio data recorded on the optical disc includes 2-channel intensity stereo audio data, and 5.1-channel stereo audio data which is an extension of the 2-channel intensity stereo audio data. The representation "0.1" of 5.1-channel stereo represents a subwoofer channel for covering low frequency components, and has no relationship to stereophony (stereo effect).

In this embodiment, for brevity of description, it is assumed that audio data to be played back be intensity stereo audio data having two channels on left and right sides. In other words, the audio data to be played back is recorded on the L-ch and R-ch at the same level and with the same timing so that, when the audio data is played back, a sound image is localized at a central position between L-ch and R-ch speakers.

The demultiplexing circuit 2 separates the supplied multiplex data into video data, subtitle data, L-ch and R-ch audio data items, and various types of other data. The demultiplexing circuit 2 supplies with the separated L-ch and R-ch audio data items to the audio data decoder 31 of the audio data processing system 3. The demultiplexing circuit 2 supplies the separated subtitle data to the subtitle data decoder 41 of the video data processing system 4, and supplies the separated video data to the video data decoder 43 of the video data processing system 4. The other data is supplied-and used in a controller (not shown) for various types of control, etc.

The subtitle data decoder 41 of the video data processing system 4 performs decompression or the like on the supplied subtitle data to restore the original subtitle data prior to data compression, and supplies the original subtitle data to the subtitle playback circuit 42. By performing necessary processing, such as digital-to-analog conversion into an analog signal, on the supplied subtitle data, the subtitle playback circuit 42 forms a subtitle signal to be combined with a video signal, and supplies the subtitle signal to the superimposition circuit 45.

The video data decoder 43 of the video data processing system 4 performs decompression or the like on the supplied video data to restore the original video data prior to data compression, and supplies the video data to the video playback circuit 44. The video playback circuit 44 performs necessary processing, such as digital-to-analog conversion into an analog signal, on the supplied video data to form a video signal for playing back video, and supplies the video signal to the superimposition circuit 45.

By performing predetermined processing on the supplied video signal so that the subtitle signal is combined with the supplied video signal, the superimposition circuit 45 forms the video signal combined with the subtitle signal, and supplies the formed video signal to the video display unit 46. The video display unit 46 includes a display element such as an LCD (liquid crystal display), a PDP (plasma display panel, an organic EL (electro luminescence) display, or a CRT (cathode-ray tube), and displays, on a display screen of the display element, video based on the video signal from the superimposition circuit 45.

In this manner, video based on the video data and subtitle data read from the optical disc is displayed on the display screen of the video display unit 46. Although, in this embodiment, the playback apparatus itself includes up to the video display unit 46, the playback apparatus is not limited to this embodiment. The playback apparatus may have a configuration in which a video signal for playback from the superimposition circuit 45 is supplied to an external monitor receiver. The playback apparatus may also have a configuration in which the video signal for playback from the superimposition circuit 45 is converted from analog to digital form and the video signal in digital form is output.

By performing decompression or the like on the supplied L-ch and R-ch audio data items, the audio data decoder 31 of the audio data processing system 3 restores the original audio data items prior to data compression. The audio data decoder 31 also forms audio data items on plural channels corresponding to the speakers of the array speaker system 34 formed by providing a plurality of (for example, 12 to 16) small speakers (electroacoustic transducers) so as to be adjacent to one another, as also described later, and supplies the plural channel audio data items to the sound field generating circuit 32. In other words, the audio data decoder 31 has a forming function for forming an audio signal on each channel which is subject to signal processing for sound field generation.

The sound field generating circuit 32 includes digital filter circuits respectively corresponding to supplied plural channel audio data items, and is a portion in which, by performing digital signal processing on the plural channel audio data items corresponding to the speakers of the array speaker system 34, sounds emitted from the speakers of the array speaker system 34 can form virtual sound sources (virtual speakers) having two channels on left and right sides, whereby stereophony (stereo effect) can be realized.

The plural channel audio data items processed by the sound field generating circuit 32 are supplied to the n-channel (plural-channel) amplifying circuit 33. The n-channel amplifying circuit 33 converts the supplied plural channel audio data items from digital into analog signals, amplifies the analog signals to a predetermined level, and supplies the amplified analog signals to corresponding speakers among the speakers of the array speaker system 34.

As described above, the array speaker system 34 is formed by providing, for example, 12 to 16 small speakers so as to be adjacent to one another. By using the speakers to emit sounds based on the audio signals supplied to the speakers, L-ch and R-ch virtual sources can be formed, thus realizing stereophony.

As described above, the sound field control circuit 35 can form an appropriate sound field by controlling the digital signal processing circuits constituting the sound field generating circuit 32 so that an appropriate sound field can be formed. The sound field control circuit 35 has a microcomputer configuration including a CPU (central processing unit), ROM (read-only memory), and RAM (random access memory), which are not shown in FIG. 1.

In other words, in the playback apparatus according to this embodiment, the sound field generating circuit 32 and the sound field control circuit 35 are used to realize a signal processing function for forming and controlling a targeted sound field.

In the above manner, the array speaker system 34 emits sounds based on the L-ch and R-ch audio data items recorded on the optical disc, whereby plural channel audio data items recorded on the optical disc can be played back and used.

The audio data items and video data recorded on the optical disc loaded in the optical disc reading unit 1 form movie content including audio data and video data that are played back, with both synchronized with each other. Processing of the audio data processing system 3 and processing of the video data processing system 4 are executed, with both synchronized with each other. Sound based on the audio data recorded on the optical disc, which is to be played back, and video based on the video data recorded on the optical disc, which is to be played back, are played back, with both synchronized with each other.

In the playback apparatus according to this embodiment, even if a position at equal distances from the L-ch and R-ch virtual sound sources is not a listening position, when sounds from the L-ch and R-ch virtual sound sources are listened to, the sound field generating circuit 32 and the sound field control circuit 35 localize a sound image at an intermediate position between the L-ch and R-ch virtual sound sources.

Regarding Sound Image Position in Stereo Reproduction

A sound image position in two-channel intensity stereo reproduction is described below. In two-channel intensity stereo reproduction, in order to localize a sound image between the L-ch and R-ch speakers, level allocation of signals to the L-ch and the R-ch is controlled correspondingly to the position of the sound image.

When the sound image is localized, for example, at just the center (central position) between the R-ch speaker and the L-ch speaker, the audio signals are allocated to the L-ch and R-ch speakers at the same signal level. When the sound image is localized from the central position to a position shifted to the right side (the side of the R-ch speaker), the allocated level of the audio signal to the R-ch speaker is increased (see reference: Journal of the Acoustical Society of Japan, vol. 33, No. 3, pp. 116-127, "*Sutereo-onba-no Kaiseki-ho to sono Oyo* (Method for Analyzing Stereo Sound Field and Application Thereof)", table 2).

In an intensity stereo method, when the sound image position is controlled, signal allocation to the R-ch and signal allocation to the L-ch have the same temporal timing. Accordingly, only level allocation to the L-ch and the R-ch is changed. The image sound position in intensity stereo reproduction is set assuming a case in which a listening position, such as the listening position A or D in FIG. 15, has approximately equal distances from the L-ch and R-ch speakers. For example, when a listening position, such as the listening position B, C, E, or F, is shifted to either right or left side, a sound image is perceived in a direction different from an assumed sound image direction.

Figure 15:
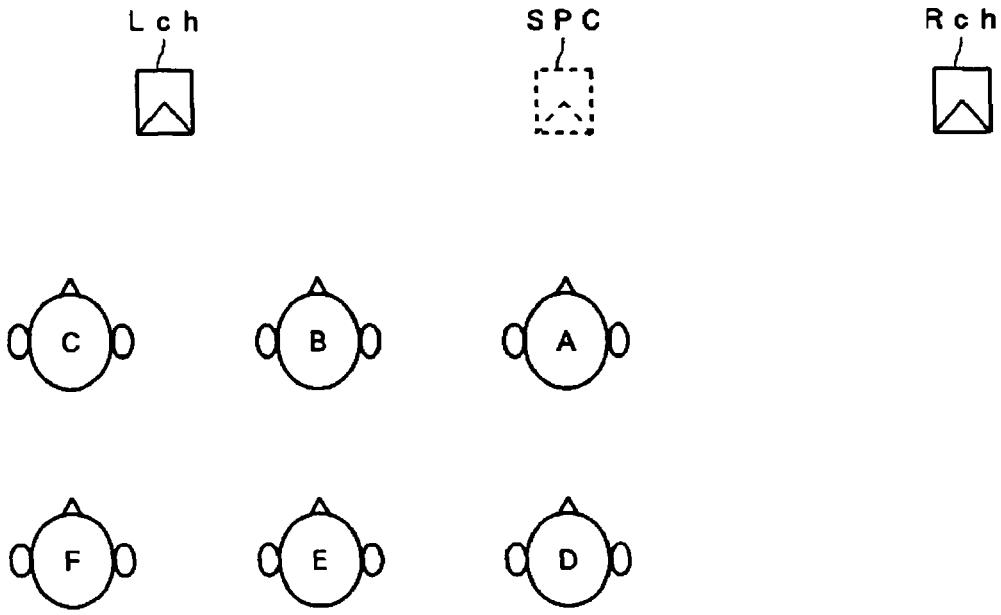
FIG. 15 is an illustration of an example of the case of intensity stereo reproduction of the related art.
Figure 16:
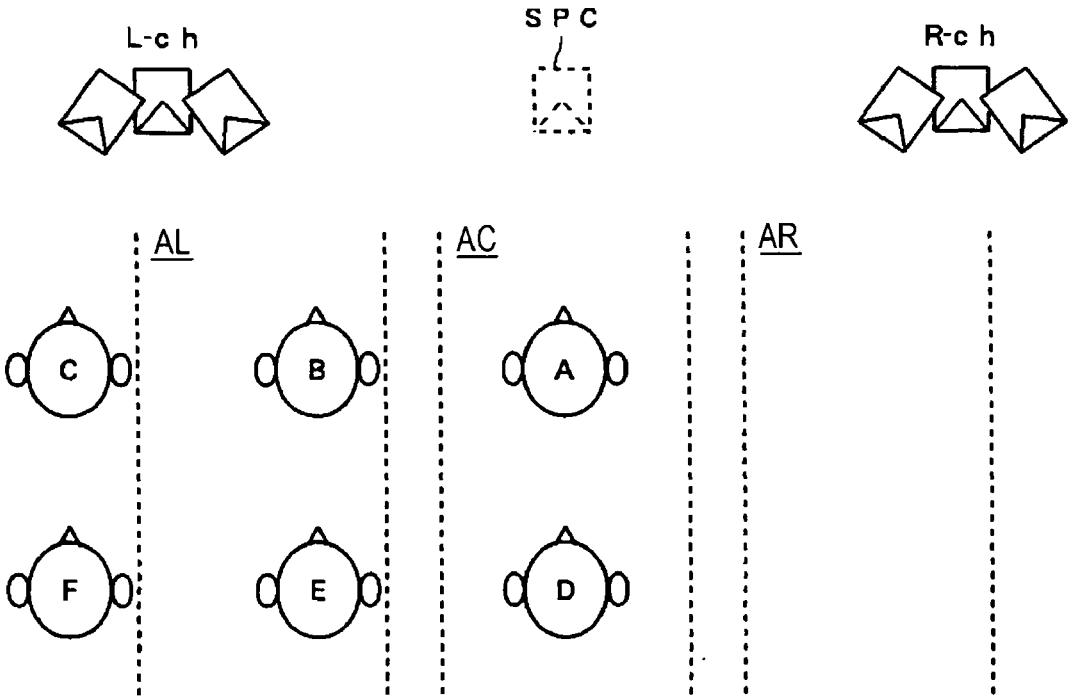
FIG. 16 is an illustration illustrating an example of the case of intensity stereo reproduction of the related art.

For example, even if there are sound sources having L-ch and R-ch to which the same level is allocated in order to localize a sound image at a central position (sound-image-localized position, such as the position SPC in the predetermined listening area shown in FIG. 15, assumed as a position in front of the listener), when the listening position is shifted to the left, as indicated by the listening position B, C, E, F, or the like, in FIG. 15, it is difficult to perceive the sound image at the central position, and the precedent effect causes perception of the sound image at the position of the L-ch speaker in the direction of a first-arriving sound.

Figure 2:
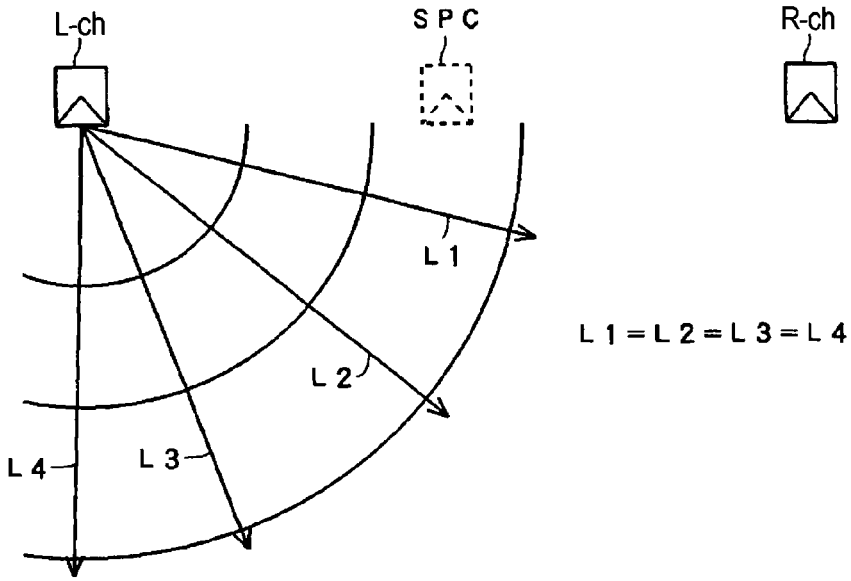
FIG. 2 is an illustration of emission of sound from speakers.

In addition, acoustic waves from the L-ch and R-ch speakers are emitted so that any direction normally has a uniform sound pressure as much as possible, as shown in FIG. 2 that is an illustration of sound emission from the L-ch speaker. Thus, shifting of the listening position to the left side causes listening to loud sound from the L-ch speaker, so that the sound image position is shifted to the left side.

Figure 3:
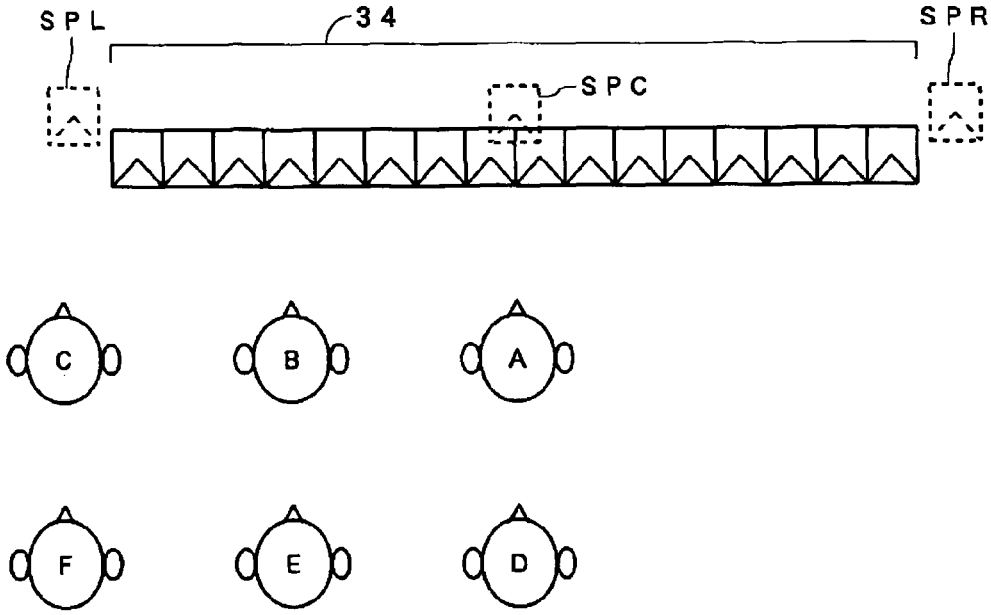
FIG. 3 is an illustration of an example of the configuration of an array speaker system used in the playback apparatus shown in FIG. 1, virtual sound sources (virtual speakers), and a sound image localization position.

The playback apparatus according to this embodiment includes the array speaker system 34, as described above. The array speaker system 34 is formed by providing, for example, a plurality of small speakers so as to be adjacent to one another, as shown in FIG. 3. As described later, by using a sound image generating and controlling technology (wave field synthesis), a right virtual sound source (virtual speaker) SPR and a left virtual sound source (virtual speaker) SPL are provided as indicated by the broken lines shown in FIG. 3. In addition, by enabling the listener to perceive sounds emitted in the directions of the virtual speakers SPR and SPL, the sound image can be localized at an assumed sound image position SPC in the center of the array speaker system 34.

Although, in this state, the sound image can be localized (perceived by the listener) at the sound image position SPC for the listening positions A and B, which are in the center in FIG. 3, for the listening positions B and E, the position at which the sound image is perceived is shifted from the assumed sound image position SPC, and, for the listening positions C and F, the position at which the sound image is perceived is more shifted.

Accordingly, in the playback apparatus according to this embodiment, by using time-intensity trading between a level difference and time difference between both ears of emitted sound, at any position in a broad listening range, the sound image can be perceived in a direction in which the sound image is assumed. Specifically, this can be realized by using an acoustic wave field synthesis technique on the basis of the functions of the sound field generating circuit 32 and the sound field control circuit 35.

Figure 4:
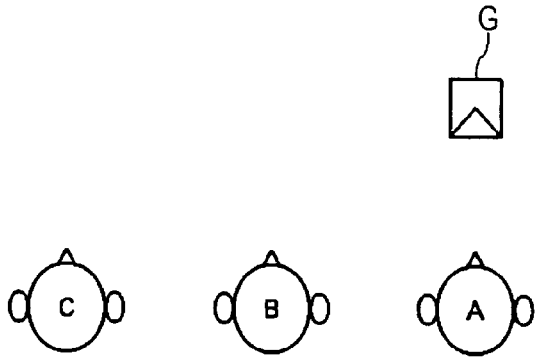
FIG. 4 is an illustration of time-intensity trading between a level difference between both ears and a time difference between both ears.

Time-intensity Trading between Level Difference and Time Difference between Both Ears Time-intensity trading between a level difference and time difference both ears is described below. FIGS. 4 to 7C are illustrations of time-intensity trading between a level difference and time difference both ears. As shown in FIG. 4, it is assumed that a predetermined test signal (impulse signal) emitted from an independent sound source G is listened to at each of a listening position A in front of the sound source G, a listening position B shifted from the listening position A to the left side, and a listening position C more shifted to the left side.

Figure 5A:
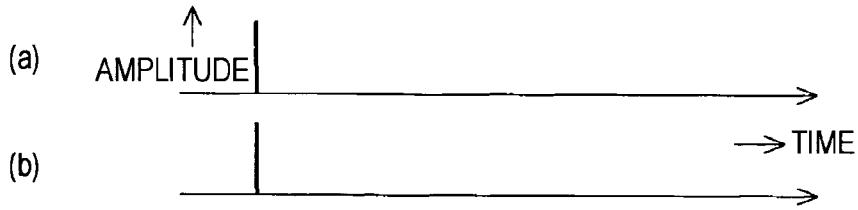
FIGS. 5A, 5B, and 5*c* are graphs illustrating time-intensity trading between a level difference between both ears and a time difference between both ears.
Figure 5B:
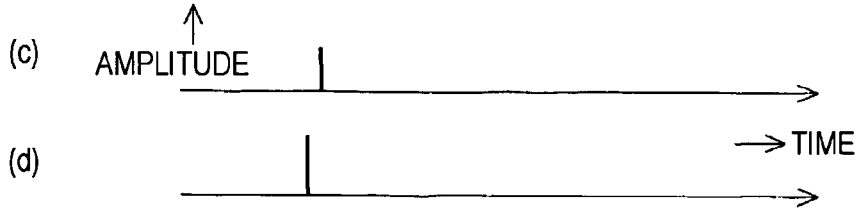
Figure 5C:
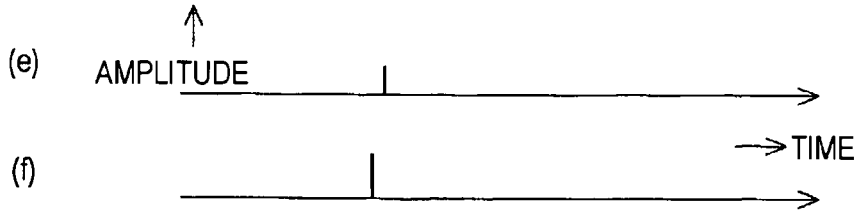

In this environment, impulse waveforms to both ears of a listener at the listening position A are shown in parts (a) and (b) of FIG. 5A, impulse waveforms to both ears of a listener at the listening position B are shown in parts (c) and (d) of FIG. 5B, and impulse waveforms to both ears of a listener at the listening position C are shown in parts (e) and (f) of FIG. 5C.

In other words, each impulse waveform shown in FIG. 4 is an impulse waveform measured in the vicinity of each of both ears of each listener at each listening position when the predetermined impulse signal is emitted from the sound source G. Parts (a) and (b) of FIG. 5A respectively show impulse waveforms in the vicinity of the left and right ears of the listener at the listening position A. Parts (c) and (d) of FIG. 5B respectively show impulse waveforms in the vicinity of the left and right ears of the listener at the listening position B. Parts (e) and (f) of FIG. 5C respectively show impulse waveforms in the vicinity of the left and right ears of the listener at the listening position C.

Therefore, a point at which the impulse waveform is generated indicates a reaching time (reaching timing) at which the impulse waveform reaches one ear of the listener, and the amplitude of the impulse waveform indicates a sound pressure level (signal level) of sound reaches one ear of the listener.

When, at the listening position A shown in FIG. 4, the listener opposes the sound source G, the distances from both ears of the listener to the sound source G are equal. Accordingly, in this case, as shown in parts (a) and (b) of FIG. 5A, the impulse waveforms to both ears indicate that the reaching times and the sound pressure levels are equal for both ears.

However, when, at the listening position B shown in FIG. 4, the listener faces front, the distances and orientations of both ears to the sound source G differ. In other words, the right ear is closer to the sound source G. In this case, as shown in parts (c) and (d) of FIG. 5B, the impulse signal to the right ear has an earlier reaching time than that of the impulse signal to the left ear, and also has a larger sound pressure level. Reaching times of the impulse signal to both ears are behind compared with the case of the listening position A, and sound pressure levels of the impulse signal to both ears are smaller compared with the case of the listening position A.

Similarly, when, at the listening position C shown in FIG. 4, the listener faces front, the distances and orientations of both ears to the sound source G further differ compared with the case of the listening position B. Accordingly, also in this case, as shown in parts (e) and (f) of FIG. 5C, the impulse signal to the right ear has an earlier reaching time and a larger sound pressure level compared with the impulse signal to the left ear. However, reaching times of the impulse signal to both ears are behind compared with the cases of the listening position A and the listening position B, and sound pressure levels of the impulse signal to both ears are smaller compared with the cases of the listening position A and the listening position B.

As described above, a time difference (time difference in sound reaching time) between both ears and a level difference (difference in sound pressure level) between both ears are generated. The time difference between both ears indicates that, regarding sound transmitted in space from the independent sound source G to reach both ears of the listener, for example, in such a case that the listeners are present at the listening positions B and C in FIG. 4, when the sound source G is on the right of the listener, a reaching time of the sound to the right ear is earlier than a reaching time of the sound to the left ear. The level difference between both ears indicates that the sound pressure of sound reaching the right ear is larger than the sound pressure of sound reaching the left ear.

Figure 6:
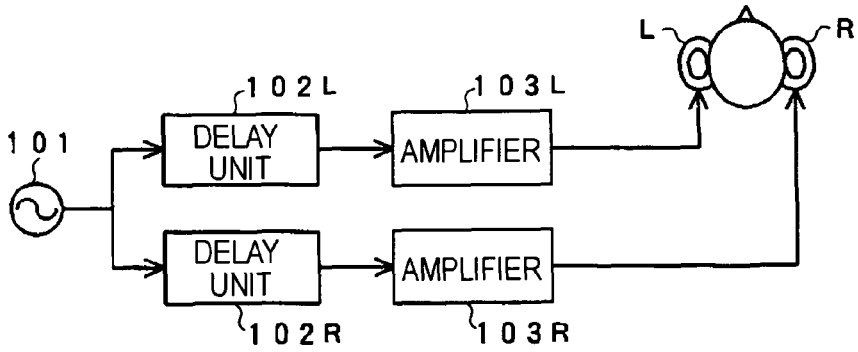
FIG. 6 is a block diagram illustrating time-intensity trading between a level difference between both ears and a time difference between both ears.

Accordingly, a sound experimental system is assumed that uses a pair of headphones in which a time difference between both ears and a level difference between both ears are adjustable. FIG. 6 is a block diagram illustrating an example of a sound experimental system using a pair of headphones in which a time difference between both ears and a level difference between both ears are adjustable. In the sound experimental system shown in FIG. 6, for an L-ch, a delay unit 102L, an amplifier 103L, and a left headphone speaker L are provided, and, for an R-ch, a delay unit 102R, an amplifier 103R, and a right headphone speaker R are provided.

In the sound experimental system, on each of the L-ch and the R-ch, a reaching time and sound pressure level can independently be adjusted. Specifically, audio signals can be supplied from a signal generator 101 to the L-ch and the R-ch. Regarding the audio signal on the L-ch, a reaching time and sound pressure level of sound provided to a user through the left speaker L can be adjusted by the delay unit 102L and the amplifier 103L. Regarding the audio signal on the R-ch, a reaching time and sound pressure level of sound. provided to a user through the left speaker R can be adjusted by the delay unit 102R and the amplifier 103R. Therefore, the experimental system shown in FIG. 6 is designed so that the time difference between both ears and the level difference between both ears can be adjusted.

In the sound experimental system shown in FIG. 6, (A) a case in which sound is emitted to both ears with the same emitting timing and with the same signal level, (B) a case in which sound is emitted to the right ear with earlier emitting timing and at a larger signal level, and (C) a case in which sound is emitted to the right ear with earlier emitting timing, while sound is emitted to the left ear at a larger signal level are considered.

Figure 7A:
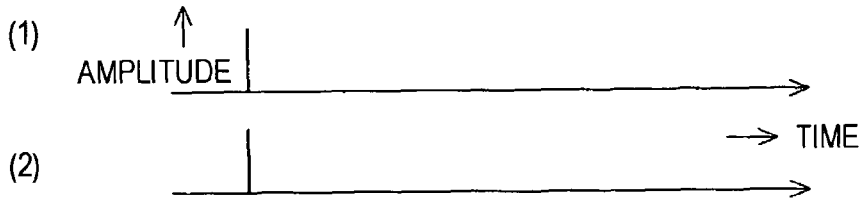
FIGS. 7A, 7B, and 7C are graphs illustrating time-intensity trading between a level difference between both ears and a time difference between both ears.
Figure 7B:
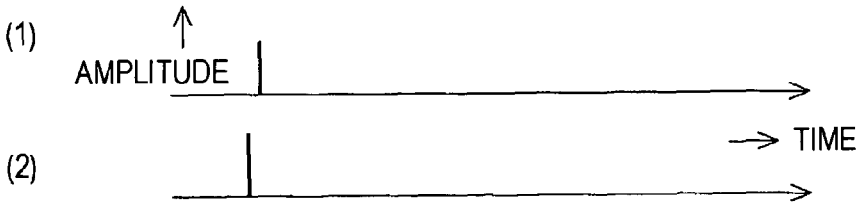
Figure 7C:
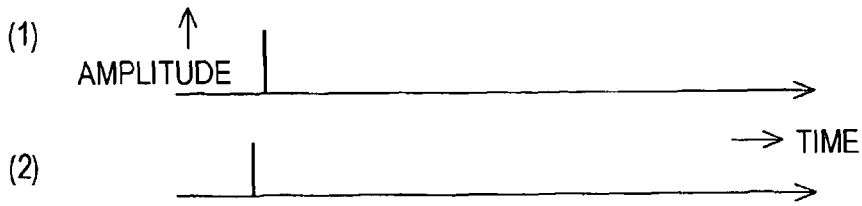

FIGS. 7A, 7B, and 7C are graphs each showing emitting times (reaching times) at sounds are emitted to both ears of the user and sound pressure levels (signal levels). In other words, each of the impulse waveforms shown in FIGS. 7A, 7B, and 7C indicates a reaching time (reaching timing) of sound that reaches each of both ears of the user in a predetermined environment, and the magnitude of each impulse waveform indicates a sound pressure level (signal level).

In the case (A) in which sound is emitted to both ears with the same emitting timing and with the same signal level, as shown in parts (1) and (2) of FIG. 7A, reaching times and sound pressures of sound to both ears are equal for both ears.

In the case (B) in which sound is emitted to the right ear with earlier emitting timing and at a larger signal level, as shown in parts (1) and (2) of FIG. 7B, a reaching time of sound to the right ear is earlier than that to the left ear, and a sound pressure level of sound to the right ear is larger than that to the left ear.

In the case (C) in which sound is emitted to the right ear with earlier emitting timing, while sound is emitted to the left ear at a larger signal level, as shown in parts (1) and (2) of FIG. 7C, a reaching time of sound to the right ear is earlier and a sound pressure level of sound to the left ear is larger.

In the case (A) (the state shown in parts (1) and (2) of FIG. 7A) in which sound is emitted to both ears with the same emitting timing and with the same signal level, the sound image of the emitted sound is perceived at a position (central position) having equal distances from both ears of the user. In the case (B) (the state shown in parts (1) and (2) of FIG. 7B) in which sound is emitted to the right ear with earlier emitting timing and at a larger signal level, the sound image of the emitted sound is heard at a position closer to the right ear of the user.

However, in the case (C) (the state shown in parts (1) and (2) of FIG. 7C) in which sound is emitted to the right ear with earlier emitting timing, while sound is emitted to the left ear at a larger signal level, a phenomenon can be confirmed in which the sound image of the emitted sound is perceived returning to the central position, which has equal distances from both ears of the user, compared with the case (B) (the state shown in parts (1) and (2) of FIG. 7B) in which sound is emitted to the right ear with earlier emitting timing and at a larger signal level.

As in the cases described with reference to FIGS. 6 and 7A to 7C, ability to exchange such a time difference between both ears that a right ear has an earlier reaching time of sound than a left ear, and such a level difference between both ears that a left ear has a larger sound pressure level than a right ear is time-intensity trading between the level difference and time difference between both ears.

Interaction between level difference and time difference between both ears has been known as a phenomenon for a single sound source. The present inventors have confirmed that the above interaction can be applied to an integrated sound image such as an intensity stereo sound image generated by two sound sources, an L-ch speaker and an R-ch speaker. As described above, by using time-intensity trading between the level difference and time difference between both ears, in a broad listening range, the sound image can be perceived in an assumed direction.

In the playback apparatus according to the embodiment, in order to utilize time-intensity trading between the level difference and time difference between both ears, as described above, by using the sound field generating and controlling technology (wavefront synthesis technology), a shift in sound image position due to the time difference between both ears can be canceled. In order to generate a reverse level difference between both ears, the sound pressure distribution of the sound field can be controlled.

Regarding Sound Field Generating and Controlling Technology

Here, the sound field generating and controlling technology is described below. Methods for controlling a sound field in three-dimensional space include a method that uses the following Kirchhoff's integral formula, as shown in, for example, Waseda University, Advance Research Institute for Science and Engineering, Acoustic Laboratory, Yoshio YAMAZAKI, "Kirchhoff-sekibun-hoteishiki-ni Motozuku Sanjigen-barcharuriarithi-ni Kansuru Kenkyu (Study on Virtual Reality based on Kirchhoff's Integral Equation)".

Figure 8:
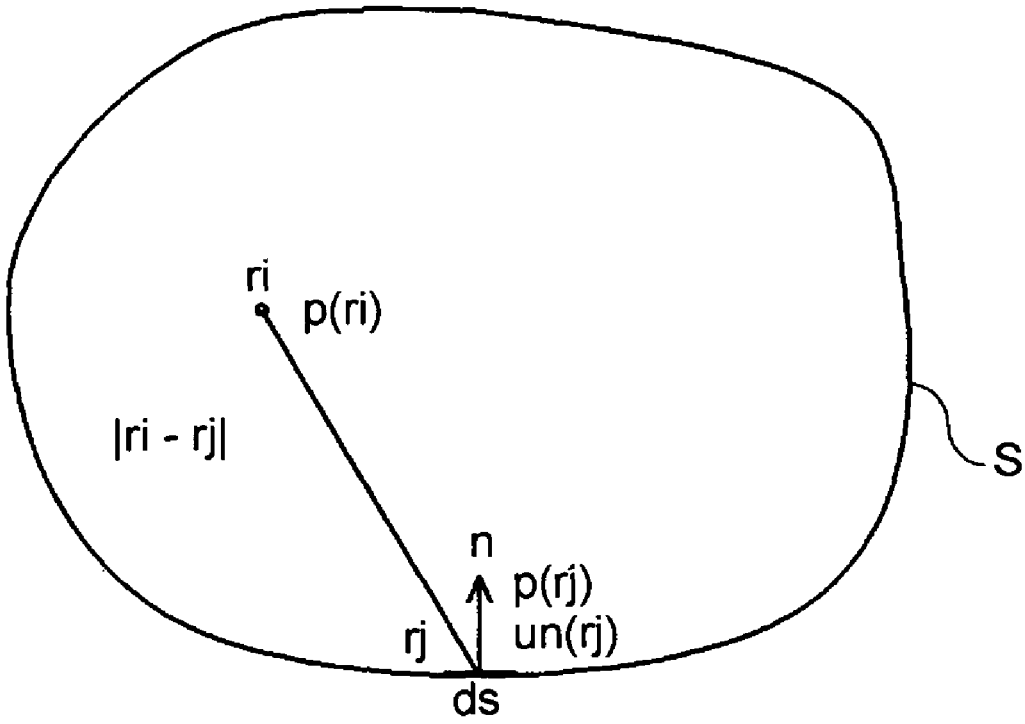
FIG. 8 is an illustration of a sound field in a virtual closed surface including no sound source.

In other words, when closed surface S including no sound source is assumed as shown in FIG. 8, a sound field in closed surface S can be represented by Kirchhoff's integral formula. In FIG. 8, p(ri) represents the sound pressure of point ri in closed surface S, p(rj) represents the sound pressure of point rj on closed surface S, n represents a normal at point rj, un(rj) represents a particle velocity in the direction of normal n, and |ri-rj| represents a distance between points ri and rj.

Kirchhoff's integral formula is represented by expression (1) in FIG. 9, and indicates that, if sound pressure p(rj) on closed surface S and particle velocity un(rj) in the direction of normal n can completely be controlled, the sound field in closed surface S can completely be reproduced.

In expression (1), ω represents an angular frequency represented by $\omega=2\pi f$, ρ represents the density of air, and Gij is represented by expression (2) in FIG. 9.

Although expression (1) relates to a steady sound field, this can apply to a transient sound field by controlling instantaneous values of sound pressure p(rj) and particle velocity un(rj).

As described above, in sound field design based on Kirchhoff's integral formula, it is only necessary to reproduce sound pressure p(rj) and particle velocity un(rj) on closed surface S, which is in virtual form. However, since it is actually difficult to control sound pressure p(rj) and particle velocity un(rj) at each of consecutive points on closed surface S, closed surface S is discretized on the assumption that sound pressure p(rj) and particle velocity un(rj) are constant in a minute element on closed surface S.

By using N points to discretize closed surface S, expression (1) in FIG. 9 is represented by expression (3) in FIG. 9. Accordingly, by reproducing sound pressure p(rj) and particle velocity un(rj) at each of N points on closed surface S, the sound field in closed surface S can completely be reproduced.

Figure 10:
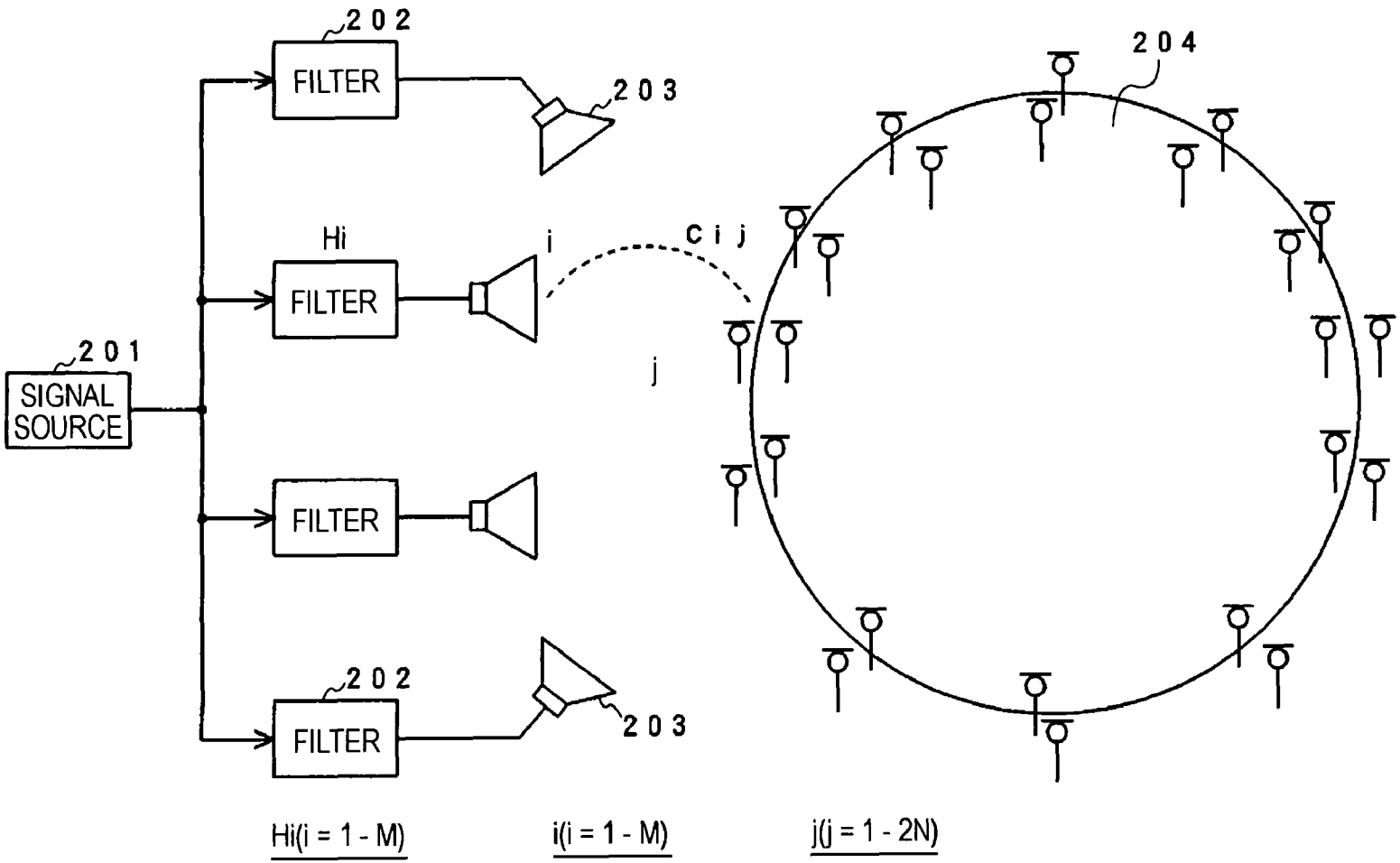
FIG. 10 is a block diagram showing a system that uses M sound sources to reproduce sound pressures and particle velocities at N points.

Systems for using M sound sources to reproduce sound pressure p(rj) and particle velocity un(rj) at each of N points include the system shown in FIG. 10.

In this system, an audio signal is supplied from a signal source 201 to speakers 203 through filters 202, and sound pressures are measured at N points on a boundary of a control region 204. Particle velocity un(rj) in the direction of the normal is approximately found from a sound pressure signal by using the two-microphone method.

At this time, to reproduce sound pressure p(rj) and particle velocity un(rj) at each of N points, it is only necessary for sound pressures at 2N points to be equal to those in the original sound field. This results in a problem of finding, as transfer function Hi (i=1 to M) of one filter 202, a value at which the sound pressures at 2N points are most approximate to those in the original sound field.

Accordingly, when each transfer function between sound source i (i=1 to M) and listening points j (j=1 to 2N) in reproduced sound field is represented by Cij, a transfer function of a filter 202 at a stage prior to sound source i is represented by Hi, and each transfer function between sound source i and listening point j in the original sound field is represented by Pj, evaluation function J, shown in expression (4) in FIG. 9, for minimizing a difference between the reproduced sound field and the original sound field, is assumed.

To find transfer function Hi in which evaluation function J represented in expression (4) is the smallest, expression (5) in FIG. 9 may be solved.

Figure 11:
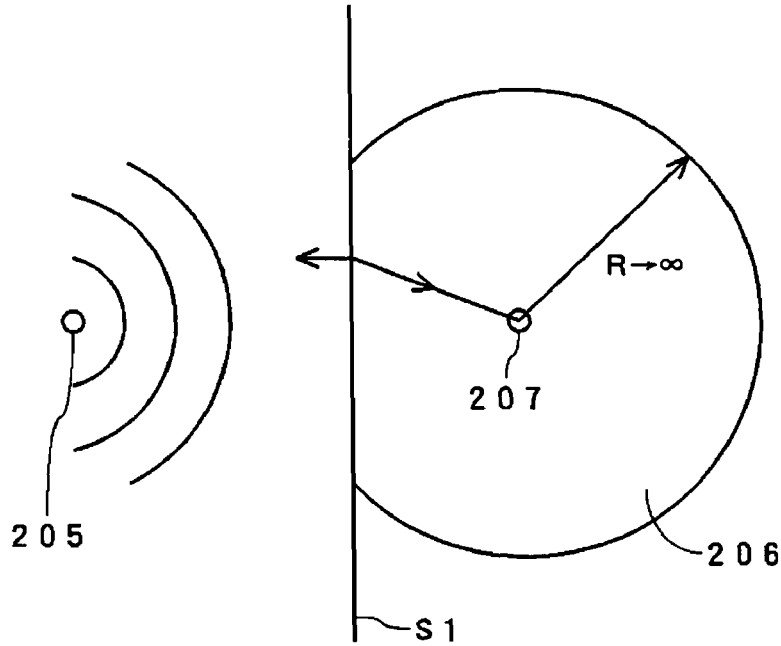
FIG. 11 is an illustration of the principle of extension of Kirchhoff's integral formula to a half space.

In addition, for extension of Kirchhoff's integral formula to half space, as shown in FIG. 11, assuming that a sound source 205 is disposed in a space on one side (the left side) of a boundary S1, and a listening region 206 including no sound source is positioned on the opposite side (the right side), by controlling a sound pressure and particle velocity at each of all points on the boundary S1 or each of the above discrete points on the basis of Kirchhoff's integral formula, a desired sound field can be realized in the listening region 206 including no sound source.

Figure 12:
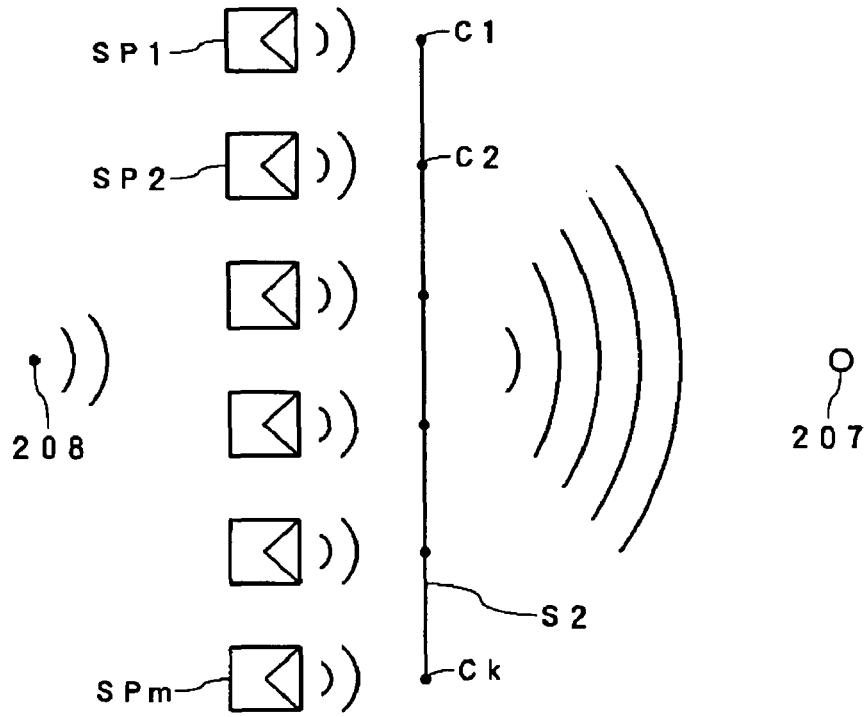
FIG. 12 is an illustration of a specific example of extension of Kirchhoff's integral formula to a half space.

Specifically, as shown in FIG. 12, by disposing a plurality of speakers SP1, SP2, . . . , SPm on the left side of a control line S2 (boundary line) having a finite length, setting a plurality of control points C1, C2, . . . , Ck on the control line S2, and controlling a sound pressure (amplitude) and phase at each of control points C1, C2, Ck, in a listening region on the right side (opposing the speakers SP1, SP2, . . . , SPm) of the control line S2, sounds from the speakers SP1, SP2, . . . , SPm can be listened to as virtual sound source 208 on the left side of the control line S2 by a listener 207.

As described above, by controlling the phase (delay time) and sound pressure (sound pressure level) of an audio signal supplied to each speaker, a targeted sound field can be generated and controlled. In the playback apparatus according to the embodiment, the sound field control circuit 35 controls a coefficient or the like of a filter circuit included in the sound field generating circuit 32, whereby a sound pressure level difference (level difference between both ears) that is opposite between both ears can be generated so that a sound pressure distribution is controlled to cancel a shift in sound image position due to the time difference between both ears.

In other words, in the playback apparatus according to the embodiment, the sound field control circuit 35 controls the sound field generating circuit 32 to control one or both of the sound pressure level and delay time of the audio signal supplied to each speaker, whereby a sound pressure distribution in the reproduced sound field is inclined depending on an emitting direction of sound so that a sound pressure distribution in a listening area is in the form of a targeted distribution.

Figure 13A:
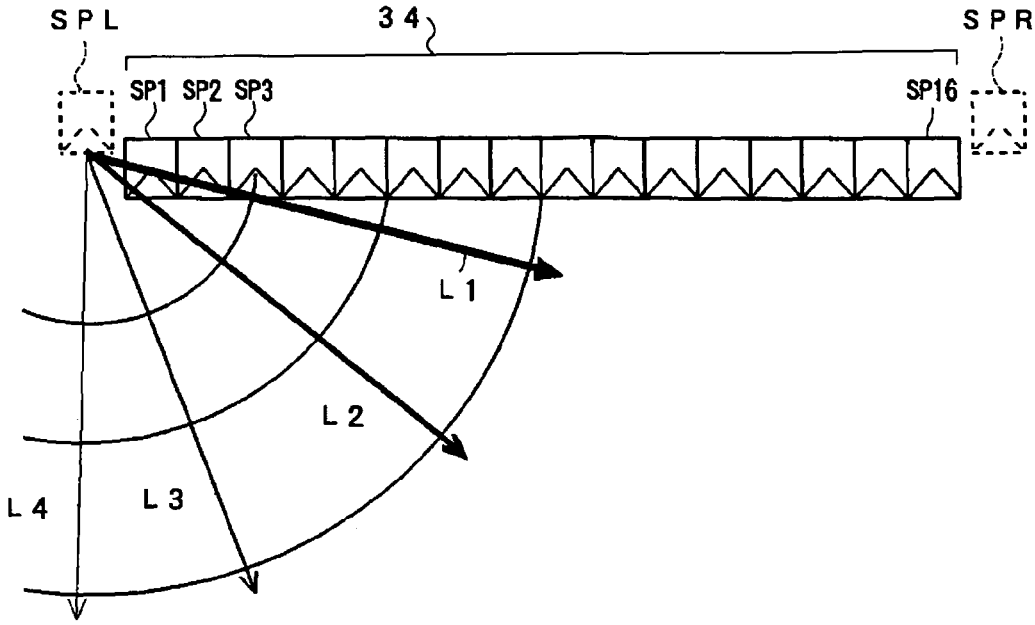
FIGS. 13A and 13B are illustrations of sound field generation and control performed in the playback apparatus shown in FIG. 1.
Figure 13B:
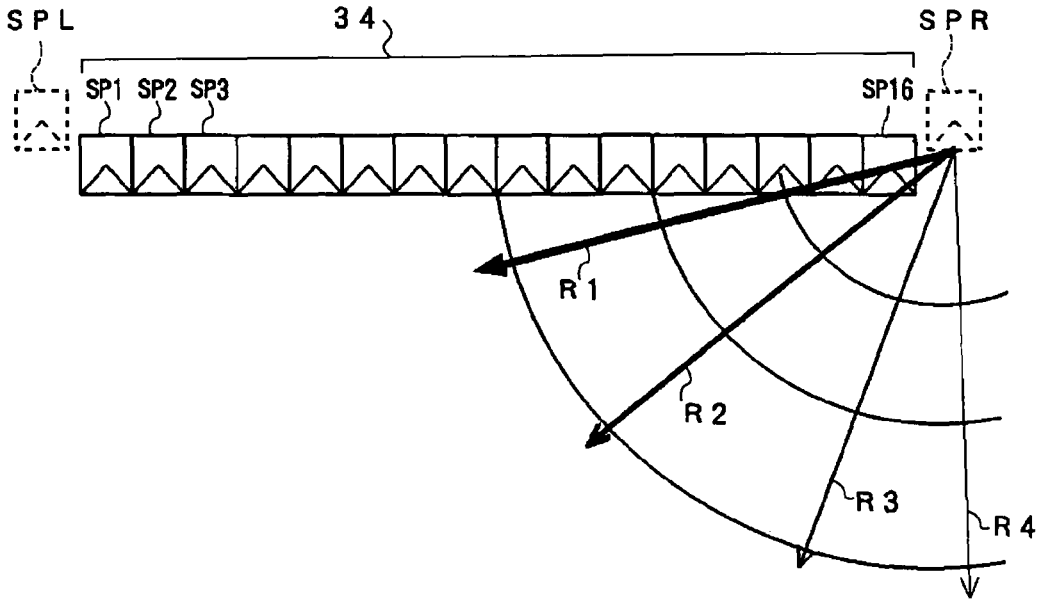

Sound Field Generation and Control in Playback Apparatus According to Embodiment FIGS. 13A and 13B are illustrations of sound field generation and control performed by the playback apparatus according to the embodiment. The playback apparatus according to the embodiment has the array speaker system 34, which is formed by disposing 16 speakers SP1 to SP16 so as be adjacent to one another.

On the basis of the functions of the sound field generating circuit 32 and the sound field control circuit 35, audio signals supplied to the speakers SP1 to SP16 are processed so that, as shown in FIGS. 13A and 13B, sounds are emitted from a right virtual sound source SPR and a left virtual sound source SPL by using the array speaker system 34.

In the playback apparatus according to the embodiment, on the basis of the functions of the sound field generating circuit 32 and the sound field control circuit 35, by processing the audio signals supplied to the speakers SP1 to SP16, as shown in FIG. 13A, on the side of the virtual sound source SPL, a part of the listening area in front of the virtual sound source SPL can have a small sound pressure. Conversely, by emitting large sound toward a part of the listening area on the side of the virtual sound source SPR, which opposes the virtual sound source SPL, even a right part of the listening area, which is away from the virtual sound source SPL, can have sound emitted from the left side.

Similarly, on the side of the virtual sound source SPR, as shown in FIG. 13B, a part of the listening area in front of the virtual sound source SPR is set to have a small virtual sound source SPR. Conversely, by emitting large sound toward the part of the virtual sound source SPL, which opposes the virtual sound source SPR, even a left part of the listening area, which is away from the virtual sound source SPR, can have large sound emitted from the right side.

In FIGS. 13A and 13B, the directions of the arrows indicate emitting directions (emitted sound directions) of sounds from the virtual sound sources SPR and SPL, and the thickness of each arrow corresponds to the sound pressure level of sound emitted in the direction. In FIG. 13A, the sound pressures of sounds emitted in the directions indicated by arrows L1, L2, L3, and L4 are set to increase as angles that are formed between the straight line connecting the virtual sound source SPL and the virtual sound source SPR, and the arrows L1, L2, L3, and L4 decrease. Relationships in sound pressure in the directions of the arrows L1, L2, L3, and L4 are represented by L1>L2>L3>L4.

In FIG. 13B, the sound pressures of sounds emitted in the directions indicated by arrows R1, R2, R3, and R4 are set to increase as angles that are formed between the straight line connecting the virtual sound source SPR and the virtual sound source SPL, and the arrows R1, R2, R3, and R4 decrease. In other words, Relationships in sound pressure in the directions of the arrows R1, R2, R3, and R4 are represented by R1>R2>R3>R4.

As described above, by performing the above sound pressure distribution control of the audio signal supplied to each speaker of the array speaker system 34, a sound image of sound which is recorded on the L-ch and the R-ch with the same timing and at the same level and which needs to be localized in the central position is localized at the central position SPC because there are no time difference between both ears and no level difference between both ears in a symmetric listening area such as the listening positions A and D in FIG. 3. In addition, in FIG. 3, at each of the listening positions B and E, the sound image is perceived at the central position because the reaching timing of sound is earlier on the left side, but the level of the reaching sound is larger. Moreover, when the listening position is shifted exceeding the ranges of the right and left virtual sound sources SPR and SPL, for example, even at each of the listening positions C and E, the sound image can be perceived in the center because the array speaker system 34 is controlled so that the reaching timing is earlier on the left side, but the level of the reaching sound is larger on the right side.

In the above description, the playback apparatus according to the embodiment uses the array speaker system 34 formed by the speakers, and the audio signal supplied to each speaker of the array speaker system 34 is processed. However, by performing the above sound pressure distribution control for L-ch and R-ch audio signals in intensity stereo system, similar effects can be obtained.

Also, regarding audio signals recorded in a state of changing allocation levels (allocated sound pressures) of the signals for the L-ch and R-ch in order to localize the sound image at an arbitrary position between L-ch and R-ch speakers, even if the audio signals are played back by a normal stereo playback apparatus and played-back sounds are listened to at shifted positions such as the listening positions B and C, the precedence effect allows the sound image to be localized in the position of a speaker in a direction in which sound first reaches the shifted positions.

By applying the sound pressure distribution control according to an embodiment of the present invention to the audio signals recorded in a state of changing allocation levels of the signals for the L-ch and R-ch, even if sound is listened to at each of the listening positions B and C, the sound image can be localized between the L-ch and R-ch speakers, or, in this embodiment, at a predetermined position between the right and left virtual sound sources SPR and SPL.

In a case in which an audio signal is recorded on only one of the L-ch and the R-ch so that reproduced sound can be heard from a speaker position, for example, if an audio signal of a musical instrument is recorded on only the L-ch, at each of the listening positions B and C, reproduced sound of the musical instrument can noticeably be heard because the virtual sound source SPL is in a closer position, so that it is difficult to listen to the reproduced sound as stereo sound having spatial balance.

Even in such a case, by using an embodiment of the present invention, since sound from the virtual sound source SPL on the left side to each of the listening positions B and C is reduced, a stereo sound field having a balance with sound emitted from the virtual sound source SPR on the right side can be reproduced and enjoyed.

In addition, in the playback apparatus according to the embodiment, control of the sound pressure distribution so that, as shown in FIG. 2, a small sound pressure is obtained, for example, in a part of the listening area which is close to the virtual sound source SPL, and control of the sound pressure distribution so that, by emitting large sound to a part of the listening position which is away from the virtual sound source SPL, sound emitted from the left side is large even in a right part of the listening area which is away form the virtual sound source SPL are realized in the array speaker system 34, which has a speaker interval shorter than the distance between the L-ch and R-ch speakers in intensity stereo by disposing the virtual sound source SPL at a more left position than a speaker at a left end.

This is an example of effectively using a property in which a sound pressure outside an end of the array speaker system 34 decreases since the speaker interval of the array speaker system 34 is shorter than the distance between the virtual sound sources SPR and SPL. This effectively uses a property in which, when a virtual sound source is set as a point sound source outside the length of the array speaker system 34, a sound pressure from a virtual point sound source decreases outside a straight line connecting the virtual sound source and an end of the array speaker system 34.

Regarding Simulation of Sound Field Generation and Control

Figure 14A:
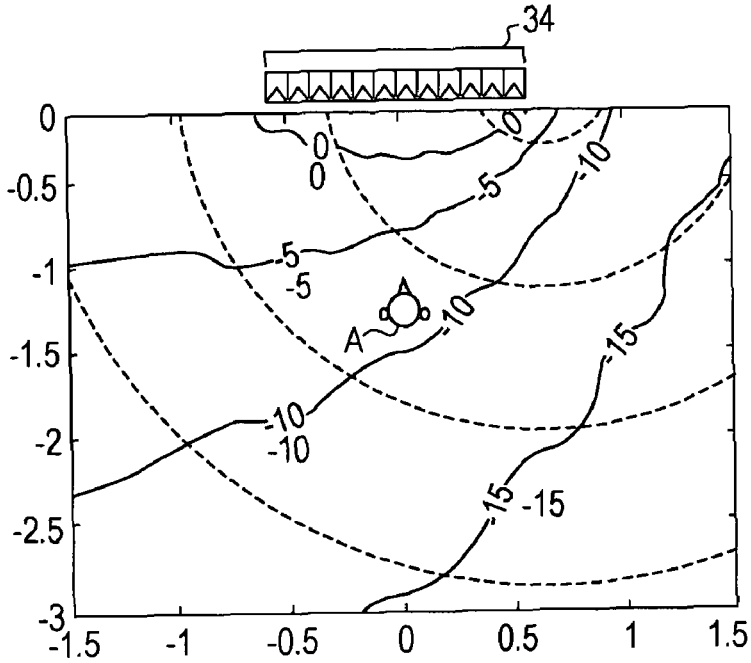
FIGS. 14A and 14B are graphs using contour drawings to show sound pressure distributions obtained when a R-ch audio signal of intensity stereo signals is emitted to a space.
Figure 14B:
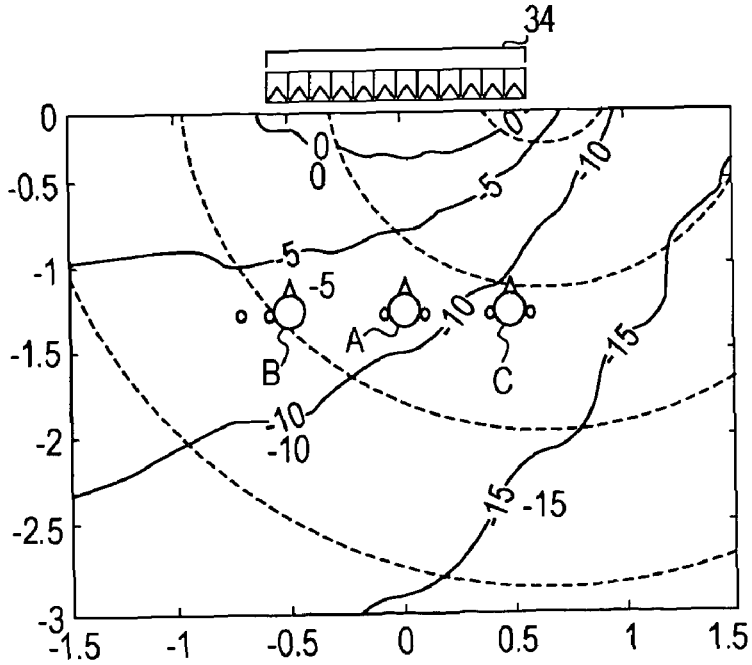

Next, the results of simulating sound field generation and control in the playback apparatus according to the embodiment are described below. FIGS. 14A and 14B are graphs that use contour drawings to show sound pressure distributions obtained when an R-ch audio signal of intensity stereo signals is emitted to space. In FIGS. 14A and 14B, for each difference of 5 dB in sound pressure level, the region is represented by contours. The semicircular broken lines shown in FIGS. 14A and 14B are equal time curves of extension of wavefront of acoustic waves.

The sound pressure distributions shown in FIGS. 14A and 14B relate to the R-ch. Also sound pressures of an L-ch audio signal are symmetrically distributed. In the simulations, the number of speakers forming the array speaker system 34 is 12, and a drawing range of sound pressure distribution begins at a position of 10 cm away from the speaker front.

In addition, in the simulation environment, the listening position A shown in FIG. 14A is a listening position on the assumption that a listener listens to emitted sound. When, in this simulation environment, assuming that a width in which the array speaker system 34 is installed is the width of a display screen of the video display unit 46, a width (stereo sound field width) in which the sound image is disposed is the width of the array speaker system 34.

Control points are set on a line (the top verge of the sound pressure distribution drawing range in each of FIGS. 14A and 14B) at a position of 10 cm ahead of the array speaker system 34, and emitting timing of emission from each speaker is determined so that times at which a wavefront reaches the control points match (as indicated by the broken lines in FIGS. 14A and 14B) the equal time curve of acoustic wave extension. In other words, a delay time of the audio signal to each speaker is determined.

In order to hear music instrument sound which is mixed in one of the L-ch and the R-ch and whose sound image is set to be localized at an end, the equal time curve of acoustic sound is determined. Specifically, to enable determining the sound image position on the basis of a difference in reaching time between both ears, the direction of a normal to the equal time curve of wavefront extension is used as an end of the video display unit 46. Actually, as shown in FIGS. 14A and 14B, good results can be obtained by preferably forming a circle whose center is at a position which is slightly away from an end of the array speaker system 34 and which is slightly at a distance (at an upper position in FIGS. 14A and 14B).

The sound pressure distribution is set in the following. The equal time curve of acoustic wave extension is set so that, when audio signals that are equally mixed in the L-ch and the R-ch so that the sound image is localized in the center are heard, sound is emitted from a closer speaker. Thus, the sound pressure distribution is set so that a level difference between both ears which can cancel a time difference between both ears due to the setting is generated.

Specifically, for the sound pressure of sound emitted from a closer channel direction, the sound pressure of sound emitted from a farther channel direction is increased by approximately 5 to 10 dB. For example, a difference between a sound pressure generated near the front of a right end of the array speaker system 34 by the R-ch sound and a sound pressure generated in the vicinity of a left end of the array speaker system 34 is set to 5 to 10 dB.

In this state, a case in which sound is listened to at each of listening positions A, B, and C, as shown in FIG. 14B, is considered. Similarly to FIG. 14A, FIG. 14B also shows the sound pressure distribution of the R-ch audio signal. Thus, regarding the R-ch sound, when comparing sound pressures at both ears of each of three listeners at the listening positions A, B, and C, a sound pressure at the right ear is less, or the sound pressure at both ears (of the left listener at the listening position B) are equal. Accordingly, the right ear has an earlier reaching time of sound. At this time, a level difference both ears concerning sound from the right side is only approximately 1 dB. Therefore, it can be confirmed that the sound image of the musical instrument sound which is mixed only in the R-ch and whose sound image needs to be localized at a right end is perceived at the right end by all the three listeners on the basis of the time difference between both ears.

In addition, regarding the musical instrument sound which is mixed in L-ch and R-ch audio signals and whose sound image needs to be localized, it is necessary to consider an influence of a sound field in the left part of the listening area, the sound field having a sound pressure distribution and equal time curves which are symmetrical with those in FIG. 14B. The central listener (at the listening position A in FIG. 14B) perceives the sound image in the center (a central portion in width of the array speaker system 34, the central portion being the center of a width in which the sound image is disposed) since the sound field is symmetric.

The listener at the listening position C in FIG. 14B perceives the sound image in the center on the basis of time-intensity trading between the level difference and time difference between both ears because sound from the right side first reaches the listening position C and sound larger in magnitude of approximately 5 dB reaches the listening position C from the left side. The listening positions A, B, and C shown in FIG. 14B are symmetric, and a sound pressure level from the left side to the right listener is equal to a sound pressure level from the right side to the left listener. Thus, it is found that the listener at the listening position C perceives the sound image in the center. In the case of the listener at the listening position B, the case of the listener at the listening position C may similarly be considered in a right-and-left reversal manner. Accordingly, the listener at the listening position B perceives the sound image in the center similarly to the case of the listener at the listening position C.

As described above, as can be understood from the simulations of the sound pressure levels in reproduced sound field, for an audio signal supplied to each speaker, by controlling a delay time and a sound pressure level, reproduced sound field having a targeted sound pressure distribution can be formed.

In the side of the virtual sound source SPL, by controlling the sound pressure distribution as shown in FIG. 13A so that a part of the listening area in front of the virtual sound source SPL has a small sound pressure, and emitting large sound to a part of the listening area on the side of the virtual sound source SPR, the part opposing the virtual sound source SPL, so that a right part of the listening area which is away from the virtual sound source SPL has large sound emitted from the left side, and, in the side of the virtual sound source SPR, by controlling the sound pressure distribution as shown in FIG. 13B so that a part of the listening area in front of the virtual sound source SPR has a small sound pressure, and emitting large sound to a part on the side of the virtual sound source SPL, the part opposing the virtual sound source SPR, so that even a part of the listening area at a distance from the virtual sound source SPR has large sound emitted from the right side, a reproduce sound field is formed, whereby, in the reproduced sound field, a sound image at any position can be perceived at each location in the listening area, which is broad.

In other words, even if emitted sound is listened to at any position in the reproduced sound field, the sound field can be localized at a sound field localization position assumed as a position at which the sound image is localized, that is, at the sound image position SPC of the array speaker system 34.

The sound image can be perceived by the listener at the assumed sound field localization position, even if the listener is not at a position having equal distances from both virtual sound sources.

As described above, in the playback apparatus according to the embodiment, by controlling outputs of the array speaker system 34 to obtain a sound pressure distribution formed so that a sound pressure, in a part of a listening area in front of either channel, caused by an audio signal on either channel, is smaller than that in an opposite part of the listening area, when a listener does not listen at a position having equal distances from both speakers, sound first reaches the listener from a closer speaker, but sound from a farther speaker has a larger level, and, even if a listener does not listen in the center of the listening area, the listener can perceive a sound image position and stereo sound similarly to the case of listening at a position having equal distances from both speakers. Accordingly, stereo music and movie sound can be enjoyed in a broad listening location.

In other words, when audio signals are played back, a sound field can be controlled so that a sound image at any position can be perceived in each location in a broad listening area, and disposing left and right virtual speakers in front of the listening area on the basis of a wave field synthesis and controlling wavefront transmission from both virtual speakers to the listening area so that an amplitude larger than that in one side is transmitted to the opposite side, a listener can perceive a synthesized sound image at a desired position, regardless of the location of the listener.

In addition, referring to the functions of the sound field generating circuit 32 and the sound field control circuit 35, the sound field generating circuit 32 and the sound field control circuit 35 cooperatively operate to control sounds on both channels output from speakers to the listening area in both directions. The control inclines the sound pressure distribution so that, regarding sound pressures on both channels, compared with a listening position on the side of the channel, a listening position on the opposite side has a larger sound pressure.

A frequency range of an audio signal to be processed has particularly no limitation. When an audio signal in a frequency range of 200 Hz or higher is processed, by applying an embodiment of the present invention, in a predetermined listening area (sound field), a sound image can be localized at a targeted position regardless of a listening position.

In the above-described playback apparatus according to the embodiment, the audio data decoder 31 forms audio signals on a plurality of channels to be supplied to the speakers of the array speaker system 34, and the sound field generating circuit 32 performs signal processing on the signals on the channels so that a sound pressure distribution in the listening area is inclined. However, the above-described playback apparatus according to the embodiment is not limited to the above-described functions.

For example, the functions of the audio data decoder 31, the sound field generating circuit 32, and the sound field control circuit 35 can be realized by a single microcomputer. In other words, a forming step of, on the basis of an audio signal to be played back, forming audio signals on a plurality of channels for emitting sounds from a pair of sound sources, and a signal processing step of, on each of the audio signals formed in the forming step, performing signal processing for forming a targeted sound field are provided. In the signal processing step, a sound pressure distribution is inclined so that, for each sound source of the pair of sound sources, sound pressure levels of sounds emitted from the sound source to a listening position increase in inverse proportion to angles formed between emitting directions of the sounds emitted from the sound source to the listening position and a straight line connecting the pair of sound sources. This makes it possible to perform processing similar to the case of the playback apparatus according to the above embodiment.

Obviously, even if this method is used, speakers for forming sound sources may be an array speaker system. For signal processing, by controlling both or one of a delay time and a sound pressure level concerning an audio signal, a targeted sound field in which the sound pressure distribution is inclined can be formed.

Although, in the above-described embodiment, a case in which intensity stereo sound is played back has been exemplified, an audio signal to be processed is not limited to a signal of intensity stereo sound. For example, the audio signal to be processed may be a monaural audio signal, and may be a multichannel audio signal such as a 5.1-channel audio signal.

Although, in the above-described embodiment, a case that uses an array speaker system formed by consecutively disposing a plurality of speakers, as shown in FIGS. 13A to 14B, has been exemplified, a set of speakers for use is not limited to the array speaker system. The set of speakers for use may be a set of array speaker systems provided at intervals, each system being formed by a plurality of speakers.

Therefore, an embodiment of the present invention is applicable to also a case in which, in the array speaker system shown in FIGS. 13A and 13B, for example, three left-end speakers SP1, SP2, and SP3, and three left-end speakers SP14, SP15, and SP16 are only provided without providing intermediate speakers SP4 to SP13. In other words, an embodiment of the present invention is not subject to the number of speakers. An embodiment of the present invention is applicable to a case in which at least one pair of speakers (actual sound sources) exists, or a case in which at least one pair of virtual speakers (virtual sound sources) exists.

Although, in the above-described embodiment, the array speaker system 34 is used and the virtual sound sources SPL and SPR are provided at both ends of the array speaker system 34, the positions of the virtual sound sources SPL and SPR are not limited to the ends. Processing so that each virtual sound source (virtual speaker) is provided at an arbitrary position is also possible.

Although, in the above-described embodiment, a case in which the array speaker system 34 is used to form the virtual sound sources SPL and SPR has been exemplified, the user of the array speaker system 34 is not limited to the formation. In other words, the virtual sound sources are not necessarily formed. Regarding sound emitted from actual speakers, by performing processing so that the above-described sound pressure distribution is inclined, a sound image can be localized at an assumed position in a relatively broad listening area, regardless of the listening position.

In the case of multichannel audio signals, by considering the number and arrangement of speakers to which the audio signals are supplied, and performing processing on audio signals emitted from each pair of speakers, similarly to the case of both channels in intensity stereo reproduction, so that the above-described sound pressure distribution is inclined, also in a reproduced sound field based on the multichannel audio signals, the sound image can be localized at an assumed position regardless of the listening position.

Although, in the above-described embodiment, a case in which an embodiment of the present invention is applied to an optical disc playback apparatus has been exemplified, one to which an embodiment of the present invention is applicable is not limited to the optical disc playback apparatus. An embodiment of the present invention is applicable to various types of playback apparatuses, such as television receivers, compact disc players, MD (Mini Disc) players, and hard disk players, which perform at least playing back audio signals.

It should be understood by those skilled in the art that various modifications, combinations, sub-combinations and alterations may occur depending on design requirements and other factors insofar as they are within the scope of the appended claims or the equivalents thereof.

What is claimed is:

1. A playback apparatus comprising:

a forming section forming, on the basis of an audio signal to be played back, audio signals on a plurality of channels for emitting sounds from a pair of sound sources; and a signal processing section for performing, on each of the audio signals formed by the forming section, signal processing for forming a targeted sound field, wherein the signal processing section increases a sound pressure distribution so that, for each sound source of said pair of sound sources, sound pressure levels of sounds emitted from the sound source to a listening position increase in inverse proportion to angles formed between emitting directions of the sounds emitted from the sound source to the listening position and a straight line connecting said pair of sound sources.

2. The playback apparatus according to claim 1, wherein the audio signals on the channels formed by the forming section respectively correspond to a plurality of speakers in a speaker array formed by providing said plurality of speakers so as to be adjacent to one another.

3. The playback apparatus according to claim 1, wherein the signal processing section inclines the sound pressure distribution in accordance with each of the emitting directions by controlling one or both of a sound pressure level and delay time for each of the audio signals on the plurality of channels.

4. A playback method comprising the steps of:

on the basis of an audio signal to be played back, forming audio signals on a plurality of channels for emitting sounds from a pair of sound sources; and on each of the audio signals formed in the forming step, performing signal processing for forming a targeted sound field, wherein, in the signal processing step, a sound pressure distribution is increased so that, for each sound source of said pair of sound sources, sound pressure levels of sounds emitted from the sound source to a listening position increase in inverse proportion to angles formed between emitting directions of the sounds emitted from the sound source to the listening position and a straight line connecting said pair of sound sources.

5. The playback method according to claim 4, wherein the audio signals on the channels formed in the forming step respectively correspond to a plurality of speakers in a speaker array formed by providing said plurality of speakers so as to be adjacent to one another.

6. The playback method according to claim 4, wherein, in the signal processing step, the sound pressure distribution is inclined in accordance with each of the emitting directions by controlling one or both of a sound pressure level and delay time for each of the audio signals on the channels.

7. A playback apparatus comprising:

a forming section forming, on the basis of an audio signal to be played back, audio signals on a plurality of channels for emitting sounds from a pair of sound sources; and a signal processing section performing, on each of the audio signals formed by the forming section, signal processing for forming a targeted sound field, wherein the signal processing section increases a sound pressure distribution so that, for each sound source of said pair of sound sources, sound pressure levels of sounds emitted from the sound source to a listening position increase in inverse proportion to angles formed between emitting directions of the sounds emitted from the sound source to the listening position and a straight line connecting said pair of sound sources, and wherein the audio signals on the channels formed by the forming section respectively correspond to a plurality of speakers in a speaker array formed by providing said plurality of speakers so as to be adjacent to one another.

* * * * *